US006736702B2

(12) United States Patent
Minami

(10) Patent No.: US 6,736,702 B2
(45) Date of Patent: May 18, 2004

(54) END FACE POLISHING MACHINE

(75) Inventor: Kouji Minami, Chiba (JP)

(73) Assignee: Seiko Instruments Inc., Chiba (JP)

( * ) Notice: Subject to any disclaimer, the term of this patent is extended or adjusted under 35 U.S.C. 154(b) by 33 days.

(21) Appl. No.: 10/219,370

(22) Filed: Aug. 15, 2002

(65) Prior Publication Data

US 2003/0064662 A1 Apr. 3, 2003

(30) Foreign Application Priority Data

Aug. 16, 2001 (JP) ..... 2001-247103
Aug. 8, 2002 (JP) ..... 2002-231039

(51) Int. Cl.[7] ..... B24B 49/00
(52) U.S. Cl. ..... 451/8; 451/11; 451/384
(58) Field of Search ..... 451/8, 5, 11, 10, 451/9, 364, 384, 57, 397

(56) References Cited

U.S. PATENT DOCUMENTS 5,459,564 A * 10/1995 Chivers ..... 356/73.1
6,157,863 A * 12/2000 Chandler et al. ..... 700/56
6,273,783 B1 * 8/2001 Kim ..... 451/8
6,488,567 B1 * 12/2002 Flanders et al. ..... 451/6
6,582,286 B2 * 6/2003 Minami et al. ..... 451/270
6,636,298 B1 * 10/2003 Bachelder et al. ..... 356/73.1

* cited by examiner

*Primary Examiner*—Dung Van Nguyen
(74) *Attorney, Agent, or Firm*—Adams & Wilks

(57) ABSTRACT

An end face polishing machine having a polishing board supported on a machine body, and an optical fiber retaining jig, and adapted to polish a free end portion of an optical fiber retained by the jig, to the shape of a wedge by a polishing member fixed to the polishing board, the machine including an inspection unit adapted to take a picture image of a free end portion of the optical fiber retained by the jig, and ascertain the position of a core on an end face of the optical fiber.

14 Claims, 5 Drawing Sheets

END FACE POLISHING MACHINE

BACKGROUND OF THE INVENTION

1. Field of the Invention

This invention relates to an end face polishing method for polishing a free end portion of an optical fiber to the shape of a wedge by an end face polishing machine.

2. Description of the Related Art

The connecting of a pair of optical fibers together in an abutted state has heretofore been done by a machine equipped with a semiconductor laser provided on the side of a free end of one optical fiber and adapted to emit the light received from the optical fiber, and a pair of optical systems adapted to turn the light from the semiconductor laser into a collimated beam and focus the beam on the other optical fiber.

In such a machine, it is necessary that the semiconductor laser and optical systems be arranged with a high accuracy with respect to the two optical fibers. When the positional accuracy of these parts arranged is low, an input loss becomes large.

Under the circumstances, a method of polishing a free end portion of one optical fiber to the shape of a wedge without providing a semiconductor laser at the free end of this optical fiber, and emitting from the polished end face the light identical with that from the semiconductor has been proposed.

When this optical fiber the free end portion of which is formed to the shape of a wedge is used, it is not necessary to carry out a position setting operation for disposing the semiconductor laser, so that a polishing machine assembling steps can be simplified.

It is necessary in such an optical fiber to set the eccentricity of a core thereof not higher than 1.0 $\mu$m. To meet the requirement, the free end portion of the optical fiber is polished to a certain extent by an optical fiber polishing machine, and the resultant optical fiber is then removed from the polishing machine to ascertain the polishing accuracy. Therefore, when the optical fiber polishing operation is restarted after setting the optical fiber on the polishing machine again, it is difficult to carry out an optical fiber-positioning operation, and the polishing accuracy is deteriorated due to a scatter of the position in which the optical fiber is set.

The repeated removing of the optical fiber from the polishing machine causes scratches on and the breakage of the optical fiber to occur, and the yield of polished products to decrease.

SUMMARY OF THE INVENTION

The present invention has been made in view of these circumstances, and provides an end face polishing method capable of improving the optical fiber polishing accuracy, reducing the optical fiber polishing time and simplifying the optical fiber polishing work.

The invention also provides an end face polishing machine equipped with a polishing board supported on a machine body and an optical fiber retaining jig, and being adapted to polish a free end portion of the optical fiber retained by the jig into the shape of a wedge by a polishing member fixed to the polishing board, the polishing machine including an inspection unit adapted to take a picture image of a free end portion of the optical fiber retained by the jig and ascertain the position of a core on an end face of the optical fiber.

The invention further provides an end face polishing method using a polishing board supported on an end face polishing machine body and an optical fiber retaining jig, and adapted to polish a free end portion of the optical fiber retained by the jig into the shape of a wedge with a polishing member fixed to the polishing board, the method being carried out by taking a picture image of the free end portion of the optical fiber by an inspection unit while light is being passed through the optical fiber, without removing the jig-fixed optical fiber from the jig, and regulating a polishing quantity of the optical fiber while ascertaining the position of a core on the end face of the optical fiber.

BRIEF DESCRIPTION OF THE DRAWINGS

The preferred embodiments of the present invention will be described with reference to the following drawings, wherein.

DETAILED DESCRIPTION OF THE INVENTION

Figure 1A:
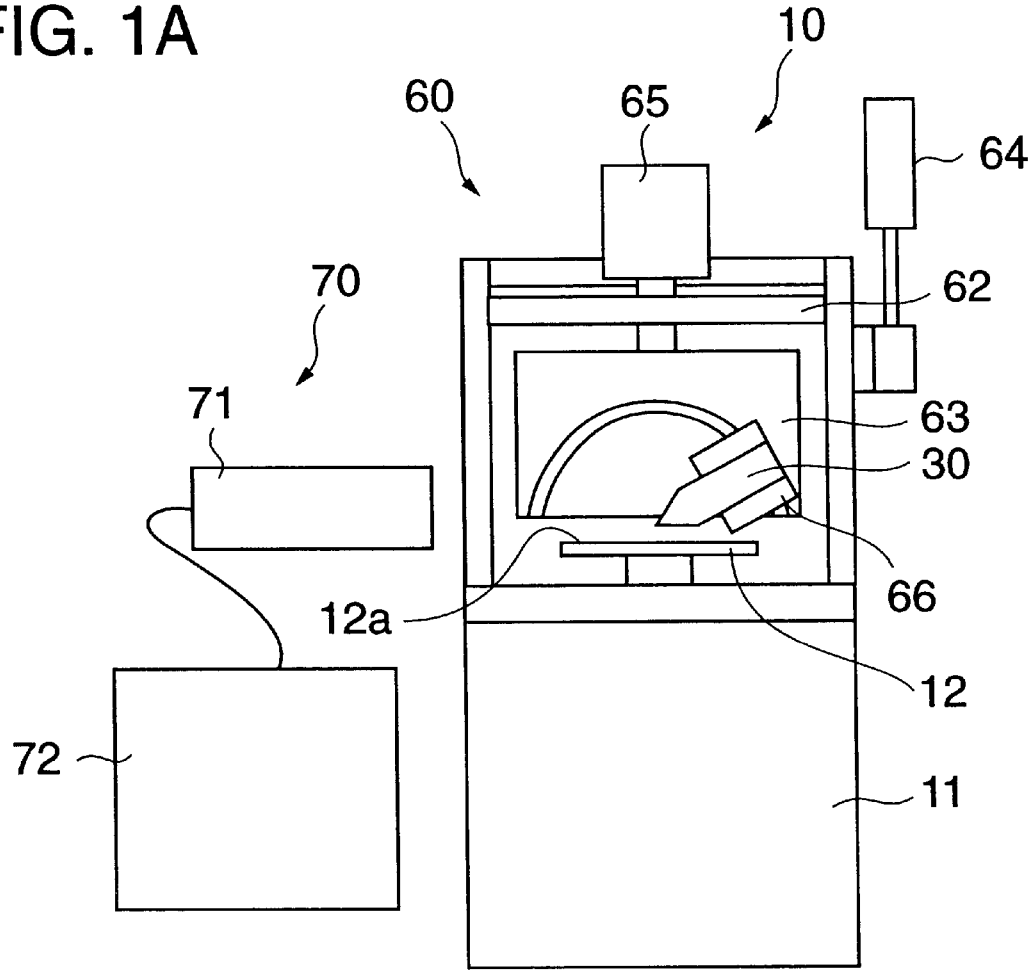
FIG. 1A is a front view and FIG. 1B is a side view of the end face polishing machine in a first one of the present invention.

The present invention resides in (1) an end face polishing machine provided with a polishing board supported on a machine body, and an optical fiber retaining jig, and adapted to polish a free end portion of the jig-retained optical fiber into the shape of a wedge by using a polishing member fixed to the polishing board, the machine including an inspection unit adapted to take a picture image of the free end portion of the jig-retained optical fiber and ascertain the position of a core on an end face of the optical fiber.

The invention also resides in (2) an end face polishing machine in accordance with (1) above, in which the jig in an optical fiber-retaining state can be moved to a position in which a free end portion of the optical fiber is pressed against the polishing board, and to a position in which an end face of the optical fiber is inspected by an inspection unit.

The invention further resides in (3) an end face polishing machine in accordance with (1) and (2) above, in which the inspection unit includes an image sensor for taking a picture image, and a display for showing thereon a picture image taken by the image sensor.

The invention further resides in (4) an end face polishing machine in accordance with any one of (1) to (3) above, in which the jig includes a contact surface formed at least a front end portion thereof out of a material the hardness of which is higher than that of the optical fiber polishing member, provided at an angle equal to that of the wedge-shaped free end portion of the optical fiber, and slidingly engaged with the polishing member; and an optical fiber insert hole extending through the jig in the axial direction thereof, opened in a free end of the contact surface, and adapted to retain the optical fiber inserted therein.

The invention further resides in (5) an end face polishing machine in accordance with (4) above, in which the jig is provided at the portion of the optical fiber insert hole which is on the side of a base end portion thereof with a member for retaining a core wire of the optical fiber thereon.

The invention further resides in (6) an end face polishing machine in accordance with (5) above, in which the retaining member includes an insert hole for the core wire of the optical fiber in which the core wire of the optical fiber is inserted and retained, and a restriction adapted to reduce the inner diameter of a part of the core wire insert hole, the core wire of the optical fiber being clamped by the restriction.

The invention further resides in (7) an end face polishing method using a polishing board supported on an end face polishing machine body, and an optical fiber retaining jig, and adapted to polish a free end portion of the optical fiber retained by the jig to the shape of a wedge by a polishing member fixed to the polishing board, the method including the steps of taking a picture image of the free end portion of the optical fiber by an inspection unit with the light passed through the optical fiber, without removing the jig-fixed optical fiber from the jig; and regulating a polishing quantity of the surface of the free end portion of the optical fiber while ascertaining the position of a core on the end face of the optical fiber.

The invention further resides in (8) an end face polishing method in accordance with (7) above, in which the ascertaining of the polishing quantity of the free end portion of the optical fiber is done by the inspection unit by moving the optical fiber retaining jig relatively to the polishing board.

The invention further resides in (9) an end face polishing method in accordance with (7) above, in which the position of the core is estimated on the basis of the symmetric property of the picture image.

The invention further resides in (10) an end face polishing method in accordance with (7) above, in which the light passed through the optical fiber is a laser beam.

According to the invention constituted as described above, a polishing operation can be carried out as the position of a core in a free end portion of an optical fiber is ascertained, without removing the optical fiber from a jig. This enables the optical fiber to be polished with a high accuracy by regulating an optical fiber polishing rate. Therefore, a polishing process can be simplified, and the polishing time can be reduced.

DESCRIPTION OF THE PREFERRED EMBODIMENTS

The modes of embodiment of the present invention will now be described in detail on the basis of what are shown in the drawings.

Mode 1 of Embodiment

Figure 1B:
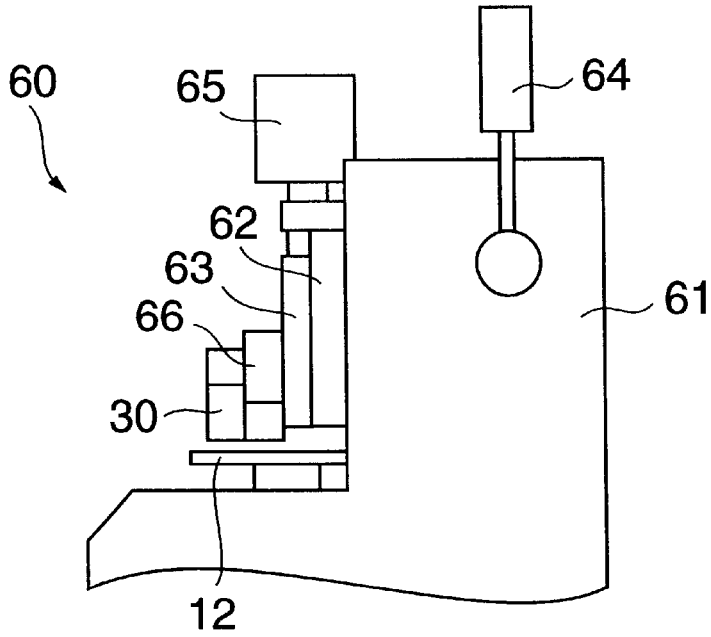

FIG. 1A is a front view and FIG. 1B is a side view of an end face polishing machine in a mode 1 of embodiment of the present invention, and FIG. 2 a perspective view of a jig in the mode 1 of embodiment and a partially cutaway exploded view in perspective of a jig in the mode 1 of embodiment.

As shown in the drawings, an end face polishing machine 10 according to the present invention includes a machine body 11 having a polishing board 12 provided so that the polishing board can be rotated and turned freely, a jig 30 retaining an optical fiber thereby, a support mechanism 60 supporting the jig 30 so that the jig can be moved freely toward the polishing board 12, and an inspection unit 70 for ascertaining the position of a core on a free end portion of the optical fiber.

Figure 2A:
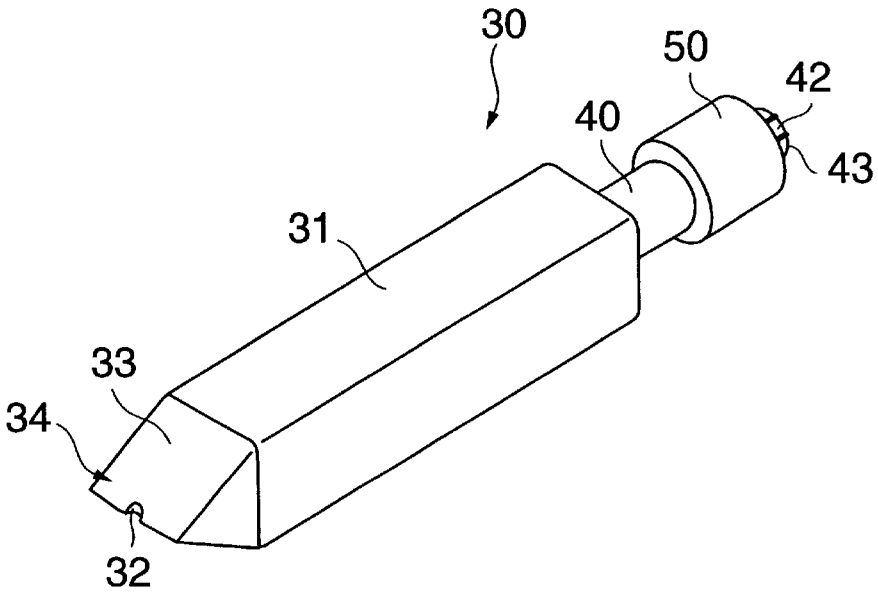
FIG. 2A is a perspective view and FIG. 2B is a partially cutaway exploded view in perspective of a jig in the first mode of the present invention.
Figure 2B:
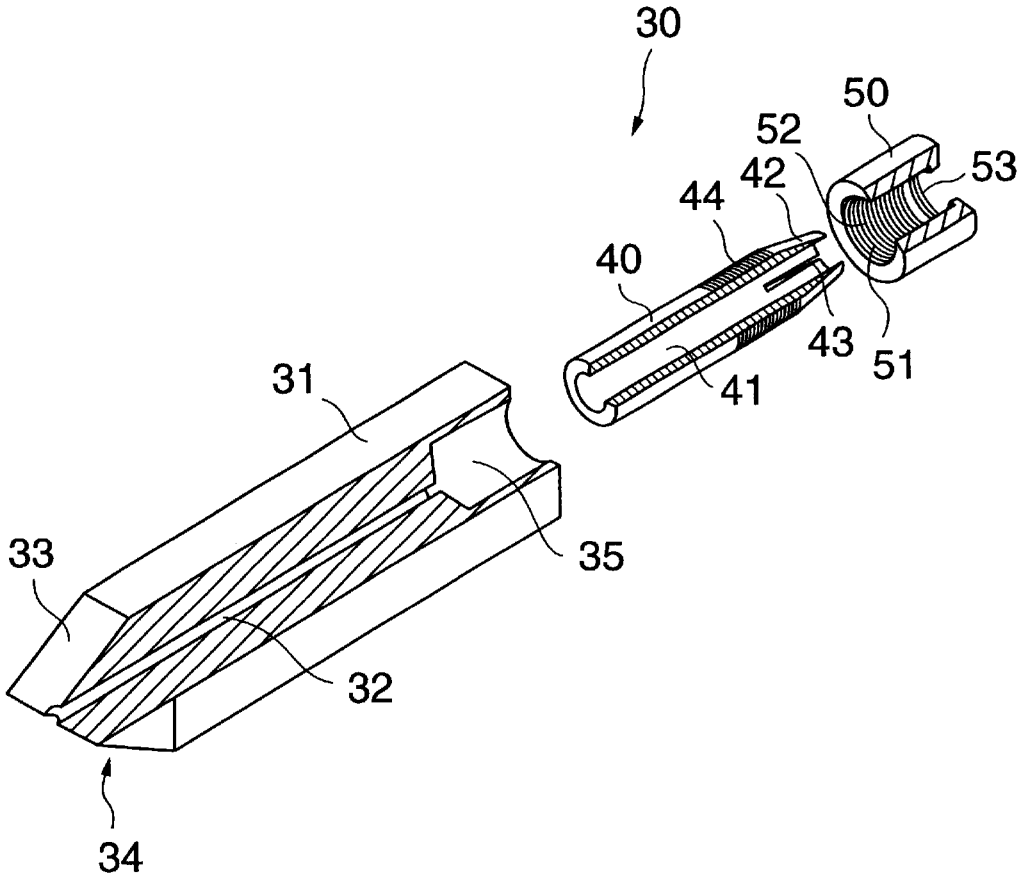

No special limitations imposed on the design of the jig 30 as long as the jig 30 as long as the jig is capable of retaining the optical fiber and can ring the free end portion thereof into contact with a polishing member 12*a* supported on the polishing board 12. In this embodiment, the jig includes, as shown in FIGS. 2A and 2B, a square pole type jig body for retaining a core wire of the optical fiber inserted and held therein, and a fastening member 50 provided on an outer circumference of the retaining member 40.

The jig body 31 has a square pole-like shape, and is provided with an optical fiber-inserting-and-holding hole 32 in a substantially central portion thereof so as to extend in the lengthwise direction thereof.

The jig body 31 is provided at its free end portion thereof with an engagement portion 34 formed by two contact surfaces 33, at free ends of which the optical fiber insert hole 32 is opened, is provided so as to incline at an angle equal to that of a wedge-shaped free end portion of the optical fiber.

The engagement portion 34, which slidingly contacts the optical fiber polishing member 12*a*, of this jig body 31 is made of a material the hardness of which is higher than that of the polishing member 12*a* so that the engagement portion is not polished when the engagement portion slidingly contacts the polishing member 12*a*, which is made of, for example, a polishing stone, an elastic stone or an abrasive sheet and a polishing liquid. Therefore, the angle of inclination of each of the contact surfaces 33 with respect to the optical fiber insert hole 32 may be determined suitably depending upon the angle to which the free end portion of the optical fiber is finished to a wedge-like shape.

The optical fiber is made of, for example, glass or a plastic material, while the polishing member 12*a* of a polishing stone, an elastic stone or a polishing sheet and a polishing liquid is made of, for example, cerium oxide, silica and zirconia. Therefore, at least the engagement portion 34 is formed of a material, for example, zirconia or alumina. In this mode of embodiment, the whole of the jig body 31 is formed of alumina.

The jig body 31 is provided at a base end portion thereof with the retaining member 40 adapted to retain an optical fiber core wire inserted therein which is formed by providing a coat on an outer circumference of the optical fiber.

The retaining member 40 has a cylindrical shape, and an optical fiber core wire insert hole 41 through which the optical fiber core wire can be inserted so as to extend in the axial direction thereof. The fastening member 50 is screwed on an outer circumference of the base end portion of the retaining member.

A free end portion of this retaining member 40 is fitted in an engagement hole 35 provided in the base end portion of the jig body 31, and having an inner diameter larger than the inner diameter of the optical fiber insert hole 32. Thus, the retaining member is fixed with the optical fiber insert hole 32 and optical fiber core wire insert hole 41 in a mutually communicating condition.

The base end portion of the retaining member 40 constitutes a tapering restriction 42 the diameter of which decreases gradually toward a base end thereof. This restriction 42 is provided with a plurality of slits 43 extending in the axial direction thereof.

In such a retaining member 40, the restriction 42 provided with the slits 43 is elastically deformed toward the optical fiber core wire insert hole 41, and thereby grips the optical fiber core wire. The material for the retaining member 40 is not specially limited as long as the restriction 42 is elastically deformed and can grip the optical fiber core wire.

Since the fastening member 50 is screwed on an outer circumference of the base end portion of the retaining member 40, a male thread 44 engaged with the fastening member 50 is provided in the same outer circumference.

The fastening member 50 is made of a cylindrical body which has an inner diameter substantially equal to the diameter of the outer circumference of the retaining member 40, and which is provided therein with an insert hole 52 in which a female thread 51 engaged with the male thread 44 of the retaining member 40 is formed. The insert hole 52 is provided at one end thereof with a pressure portion 53 having an inner diameter smaller than that of the insert hole 52.

When this fastening member 50 is screwed on the outer circumference of the retaining member 40, the pressure portion 53 slidingly contacts an outer surface of the restriction 42 of the retaining member 40, elastically deforms the restriction 42 toward the optical fiber core wire insert hole 41, and thereby retains the optical fiber core wire.

Such a jig 30 enables the optical fiber alone to be polished at an angle equal to that of the contact surface 33 by bringing an inclined surface of the engagement portion 34 of the jig body 31 into sliding contact with the polishing member 12*a* without polishing the engagement portion 34. Thus, the free end portion of the optical fiber can be polished with a high accuracy.

The support mechanism 60 supporting such a jig 30 will now be described.

As shown in FIGS. 1A and 1B, the machine body 11 is provided with the support mechanism 60 which has a support portion 61 extended in a position opposed to the polishing board 12, and which includes a high-speed table 62 provided on this support portion 61 so that the feed table can be moved toward the polishing board 12, and a precision feed table 63 held on this high-speed feed table 62 so that the jig 30 can be turned in the radial direction of the optical fiber.

The high-speed feed table 62 can be roughly moved toward the polishing board 12 by operating a high-speed feeding handle 64 provided on the support portion 61.

The precision feed table 63 is held on the high-speed feed table 62 so that the precision feed table can be moved in the vertical direction of the polishing board 12. The precision feed table can be moved finely toward the polishing board 12 by a regulator 65 including a micrometer head provided on the high-speed table 62.

The precision feed table 63 is provided with a rotary member 66 to which a side surface of the jig 30 is fixed. This rotary member 66 is adapted to rotationally move the jig 30 with respect to the polishing board 12 in the radial direction of the optical fiber. Thus, the jig can be moved to a polishing position in which the free end portion of the optical fiber retained by the jig 30 is pressed against the polishing board 12, and to a position in which the position of the core on the end face of the optical fiber is ascertained by the inspection unit 70.

When such a precision feed table 63 is pressed against the polishing board 12 by the regulator 65, the free end portion of the optical fiber and the contact surface 33 of the jig 30 are pressed against the polishing board 12 under a predetermined level of pressure, and the free end portion of the optical fiber is thereby polished.

Since the rough and fine movements of the jig 30 can be made easily by the high-speed feed table 62 and precision feed table 63, the positioning movement of the jig 30 can be made in a short period of time, and a fine adjustment of the pressure at which the free end portion of the optical fiber and the contact surface 33 of the jig 30 are pressed against the polishing board 12 can be carried out easily.

The structure of the inspection unit 70 is not specially limited as long as the device can take a picture image of the free end portion of the optical fiber and ascertain the position of the core on the free end face of the optical fiber. The inspection unit 70 in, for example, this mode of embodiment is provided with the image sensor 71, such as CCD adapted to take a picture image of the free end portion of the optical fiber retained by the jig 30, and a display (monitor) 72 connected to this image sensor 71 and displaying the picture image taken by the image sensor 71.

When according to this inspection unit 70 the rotary member 66 retaining the jig 30 is turned with the light passed through the optical fiber during the polishing of the free end portion of the optical fiber, the position of the core on the end face of the optical fiber can be ascertained without removing the optical fiber from the jig 30. Since the regulating of the quantity of polishing the free end portion of the optical fiber to the shape of a wedge can thus be done as the position of the core is ascertained, the polishing accuracy can be improved, and the polishing time can be reduced.

Since the inspection of the free end portion of the optical fiber by the inspection unit 70 can be carried out without removing the optical fiber from the jig 30, the occurrence of scratches on a polished surface of the optical fiber and the breakage of the same fiber can be prevented.

The structure of the inspection unit 70 is not specially limited as long as the inspection unit can take a picture image of the free end portion of the optical fiber and ascertain the position of the core on the end face of the optical fiber. For example, a visual ascertainment device, such as a magnifying glass may be used as the inspection unit 70.

Figure 3:
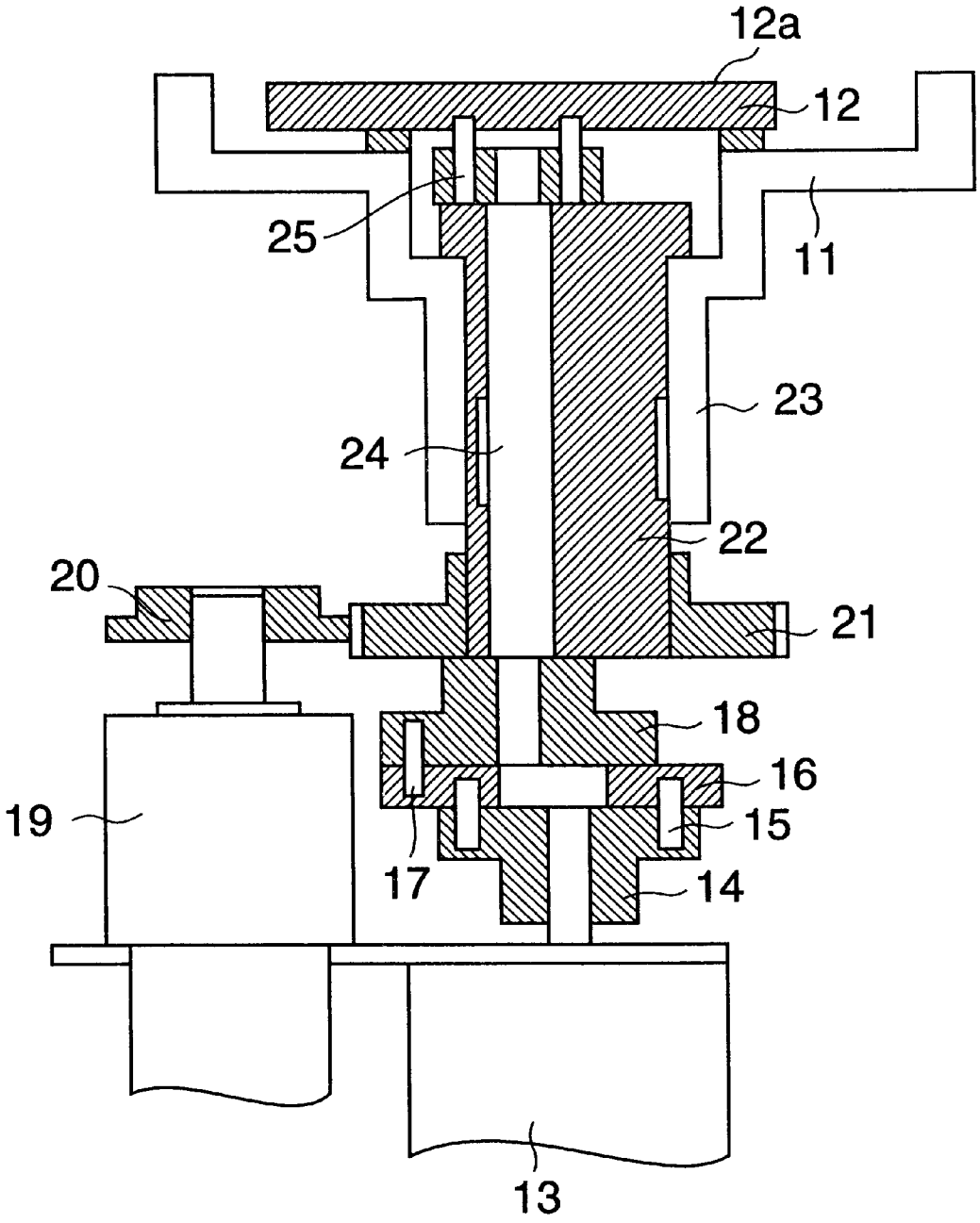
FIG. 3 is a sectional view showing a driving system for the end face polishing machine in the first mode of the present invention.

A driving system for such an end face polishing machine will now be described. FIG. 3 is a sectional view of a principal portion of the end face polishing machine in the mode 1 of embodiment.

As shown in FIG. 3, a central portion of a first self-axis-rotation transmission board 14 is fixed to a rotary shaft of a self-axis-rotating motor 13, and a plurality of first connecting pins 15 are fixed to the portions of the first self-axis-rotating board 14 which are on a circle concentric with the center of rotation of the same rotating board. These first connecting pins 15 are fixed to the portions of opposed rotation transmission boards 16 which are on a circle eccentric with respect to the center thereof, in such a manner that the rotation transmission boards 16 can be rotated. Second connecting pins 17 are fixed to the portions of the rotation transmission boards 16 which are on a circle eccentric with respect to the center of rotation of the rotation transmission boards 16. Each of these second connecting pins 17 is joined to a second self-axis-rotation transmission board 18 so that this transmission board can be rotated.

A revolution motor 19 is mounted on a rotary shaft thereof with a driving gear 20 at a central portion thereof, and a driven gear 21 is meshed with this driving gear 20. This driven gear 21 is mounted fixedly on an outer circumference of a lower portion of a revolution transmission shaft 22, and a bearing portion 23 of the machine body 11 is fitted around an outer circumference of an upper portion of this revolution transmission shaft 22. A self-axis-rotating shaft 24 is fitted rotatably in the portion of this revolution transmission shaft 22 which is offset by a predetermined distance from the center of rotation of the revolution transmission shaft 22. A lower end portion of this self-axis-rotating shaft 24 is joined fixedly to a central portion of the second self-axis-rotation transmission board 18.

An upper end portion of the self-axis-rotating shaft 24 is connected to the polishing board 12 via a joint member 25, and, moreover, the polishing member 12*a*, such as a polishing sheet is fixed on an upper surface portion of the polishing board 12.

The operation of the end face polishing machine will now be described.

First, concerning a revolution motion of the polishing machine, the revolution motor 19 is driven as shown in FIG. 3, to rotate the revolution transmission shaft 22 via the gears 20, 21, and the polishing board 12 then makes a revolution motion by a quantity corresponding to a predetermined quantity of eccentricity. Although the self-axis-rotating shaft 24 exists in the revolution transmission shaft 22, the rotation transmission board 16 rotates around the first connecting pins 15 in the same phase as the rotation of the revolution transmission shaft 22 owing to the provision of the plural rotation transmission boards 16 between the shaft 24 and first self-axis-rotation transmission board 14. Accordingly, even when the first self-axis-rotation transmission board 14 is stopped or rotated, the rotation of the revolution transmission shaft 22 is not restricted.

Concerning the self-axis-rotation of the polishing machine, the self-axis-rotating motor 13 is driven to cause the first self-axis-rotation transmission board 14 to be rotated. Since the first connecting pins 15 are provided on a circle concentric with the center of the first self-axis-rotation transmission board 14, these pins follow the same orbit as mentioned above. Although the self-axis-rotating shaft 24 is offset from the axis of the revolution transmission shaft 22 by a predetermined distance, it is connected to the first self-axis-rotation transmission board 14 via the rotation transmission boards 16, so that a rotation the frequency of which is equal to that of the rotation of the first self-axis-rotation transmission board 14 is transmitted to the self-axis-rotating shaft 24.

Owing to such rotational movements of the revolution transmission shaft 22 and self-axis-rotating shaft 24, the polishing board 12 revolves as it rotates round its own axis.

The jig 30 to which a multi-core optical fiber in this mode of embodiment fixed is moved toward the polishing board 12 by the support mechanism 60, and pressed at the end face thereof against the same board 12. This enables the free end portion of the optical fiber to be polished with a high accuracy.

A series of steps of polishing the optical fiber by using such an end face polishing machine will now be described in detail. FIG. 4 is a plan view of the jig, polishing board and inspection unit used in the polishing steps in this mode of embodiment, and FIG. 5 shows picture images obtained by the inspection unit, and a plan view of the polished optical fiber.

Figure 4A:
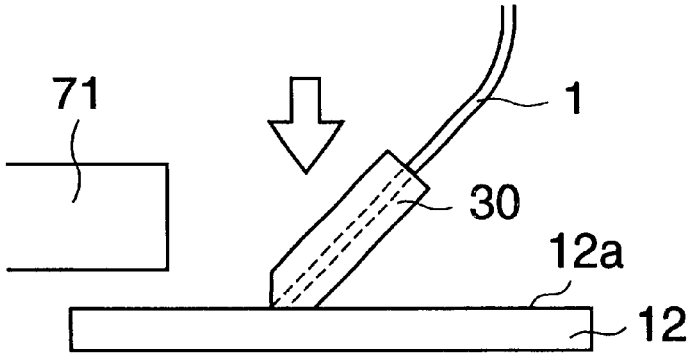
FIGS. 4A–4D are views showing a polishing process carried out by the end face polishing machine in the first mode of the present invention.

As shown in FIG. 4A, one square surface of the wedge-shape is formed on the free end portion of the optical fiber 1. In more detail, the jig 30 to which the optical fiber 1 is fixed is moved by the support mechanism 60 and engaged with the polishing board 12, a polishing operation being then carried out. After the polishing operation is carried out, the free end portion of the optical fiber 1 is washed with distilled water to remove the polishing grains and dust therefrom, and the resultant product is dried with the air.

Figure 4B:
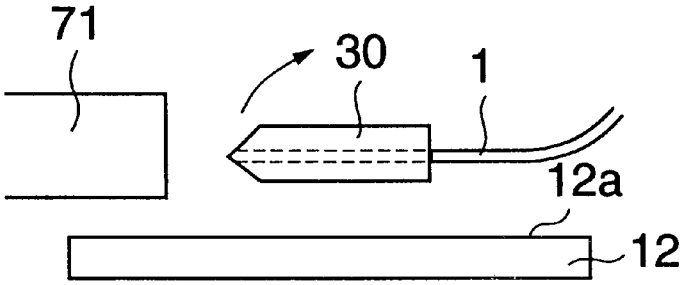

As shown in FIG. 4B, the jig 30 is moved by turning, and the polished condition of the surface being polished of the optical fiber 1 is ascertained by the inspection unit 70.

Figure 5A:
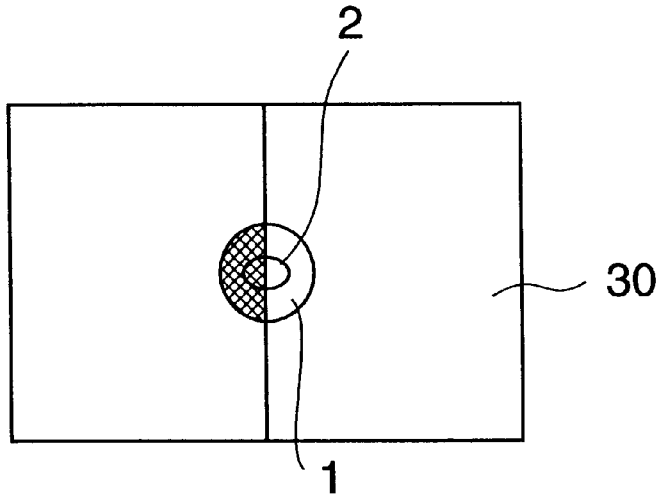
FIGS. 5A–5B are views showing picture images of a free end portion of an optical fiber taken by an inspection unit.

In this mode of embodiment, the free end surface of the optical fiber 1 is moved to a position opposed to the image sensor 71, by turning the rotary member 66 to which the jig 30 is fixed, as a 950 nm laser beam is passed through the optical fiber 1. As shown in FIG. 5A, a far field pattern is shown on the display 72, and thereby show the position of the core 2 of the optical fiber 1. With reference to what is shown on the display, it is ascertained that the square surface of the wedge-shaped portion comes to the center of the core 2 of the optical fiber 1.

When such polishing and ascertaining operations are carried out repeatedly, the square surface of the wedge-shape can be formed with a high accuracy.

Figure 4C:
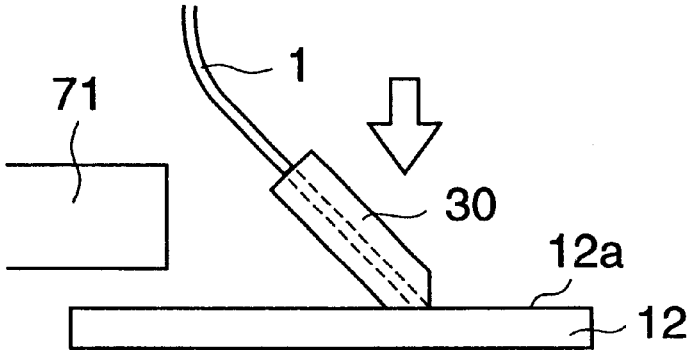

As shown in FIG. 4C, the other square surface is formed on the free end portion of the optical fiber 1 by turning the jig 30, and the wedge-shaped end portion is thereby made.

Figure 4D:
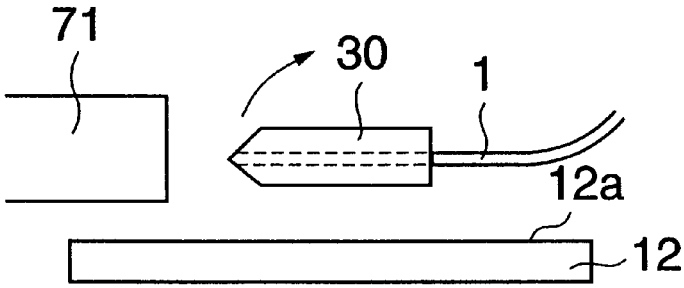
Figure 5B:
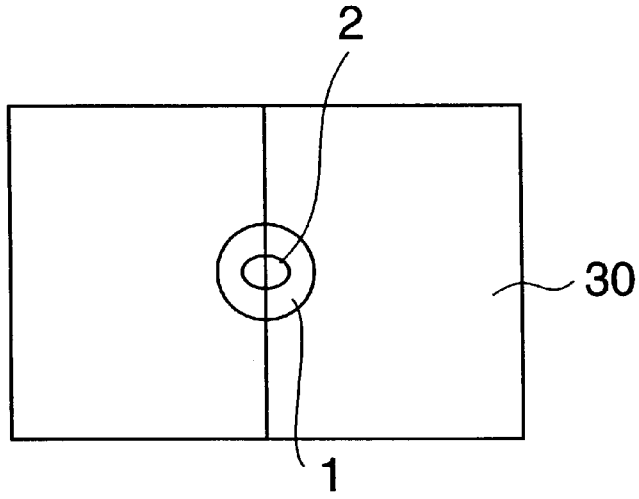

In this case, the free end surface of the optical fiber 1 is also moved to a position opposed to the image sensor 71 as shown in FIG. 4D, in the same manner as in the ascertaining operations mentioned above, by turning the rotary member 66 with the light passed through the optical fiber 1. The position of the core 2 of the optical fiber 1 is shown on the display 72 as shown in FIG. 5B. With reference to what is shown on the display, it is ascertained that the wedge-shaped end portion is formed so that the center of the core 2 of the optical fiber 1 is sharpened. When the position of the center of the core 2 of the optical fiber 1 and the center of the wedge-shaped end portion, i.e. the position of an apex of the wedge-shaped end portion agree with each other, a profile of the laser beam comes to have an elliptic shape symmetric with respect to the longer and shorter axes thereof. When the central position of the core 2 of the optical fiber and the center of the wedge-shaped end portion deviate from each other, the profile of the laser beam becomes asymmetric, and the slippage of the position can be ascertained by the picture image.

Figure 5C:
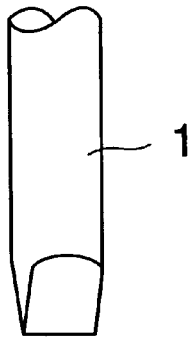
FIG. 5C is a plan view of a polished optical fiber.

Thus, the free end portion of the optical fiber 1 can be formed to the shape of a wedge as shown in FIG. 5C by easily controlling the polishing quantity by repeatedly carrying out the polishing and ascertaining operations for the second-mentioned square surface as well of the wedge-shaped end portion. The center of the core of the optical fiber and that of the wedge-shaped end portion could be set close to each other within the range of plus or minus 0.5 $\mu$m.

In such a series of polishing steps, the free end portion of the optical fiber 1 can be formed to a wedge-like shape without removing the optical fiber 1 from the jig 30. Therefore, it is possible to prevent the occurrence, which is ascribed to the re-fixing of the optical fiber to the jig, of deterioration of the polishing accuracy and scratches on the polished surface; carry out the polishing operation with a high accuracy; and simplify the polishing steps and reduce the polishing time.

Another Mode of Embodiment

The mode 1 of embodiment has been described above. The basic constitution of the end face polishing machine and method is not limited to that described above.

In the polishing steps in the mode 1 of embodiment described above, the polishing quantity is regulated by ascertaining the position of the core 2 by the inspection unit 70 even when the first-mentioned square surface forming the wedge-shaped free end portion of the optical fiber 1 is polished. The polishing operation is not limited to that described above. When the polishing of the first-mentioned square surface to be obtained first of the wedge-shaped end portion is done beyond the axis of the optical fiber to a certain extent, the inspection time can be reduced so that the sharpened portion of the second-mentioned square surface to be obtained later of the wedge-shaped end portion comes to the center of the position of the core 2, by only regulating the polishing quantity of the second-mentioned square surface to be polished later while inspecting this square surface by the inspection unit 70.

In the mode 1 of embodiment described above, the self-axis rotating shaft 24 is provided as a driving system for the end face polishing machine 10, in the position in the revolution transmission shaft which is offset from the axis of the revolution transmission shaft 22 by a predetermined distance. Special limitations are not placed on the driving system. For example, an end face polishing machine in which a revolution transmission shaft is provided in a self-axis-rotating shaft may also be employed.

According to the end face polishing method of the present invention described above, a machine provided with an inspection device for taking a picture image of a free end portion of an optical fiber retained by a jig and ascertaining the position of a core on a free end of the optical fiber is used, and a polishing quantity of the free end portion of the optical fiber is regulated as the free end portion is inspected by this inspection device. Therefore, the polishing accuracy can be improved, and the time needed to carry out the polishing work can be reduced. Moreover, since the ascertainment operation by the inspection unit is carried out without removing the optical fiber from the jig, the occurrence of scratches on the free end surface of the optical fiber and the breakage of the same fiber can be prevented.

What is claimed is:

1. An optical fiber polishing machine comprising: a machine body; an optical fiber retaining jig supported by the machine body for retaining an optical fiber; a polishing board supported by the machine body and having a polishing member for polishing a free end of an optical fiber retained by the retaining jig into a desired shape; and an inspection unit for acquiring an image of the free end of the optical fiber retained by the retaining jig to enable a user to ascertain the position of a core at the free end of the optical fiber.

2. A polishing machine according to claim 1; wherein the desired shape is a wedge shape.

3. A polishing machine according to claim 1; wherein the retaining jig is movable between a first position at which the free end of the optical fiber is urged against the polishing member and a second position at which the free end of the optical fiber may be inspected by the inspection unit.

4. A polishing machine according to claim 1; wherein location of the retaining jig at the second position places the free end of the optical fiber proximate an image sensor of the inspection unit.

5. A polishing machine according to claim 1; wherein the inspection unit has an image sensor for acquiring the image and a display for displaying the image acquired by the image sensor.

6. A face polishing machine according to claim 1; wherein the image is a far field pattern.

7. A polishing machine according to claim 1; wherein the retaining jig has a contact surface having the desired shape and being formed at a front end portion of the retaining jig from a material having that is harder than the polishing member, the contact surface being urged against the polishing member to enable polishing of the free end of the optical fiber into the desired shape.

8. A polishing machine according to claim 7; wherein the retaining jig further comprises an optical fiber insertion hole extending axially therethrough and having an opening in the contact surface for retaining the optical fiber with the free end face protruding through the opening.

9. A polishing machine according to claim 8; wherein the retaining jig further comprises a retaining member proximate an end of the optical fiber insertion hole opposite the opening for retaining a core of the optical fiber.

10. A polishing machine according to claim 9; wherein the retaining member has an insertion hole through which the core of the optical fiber is inserted and retained, and a restriction portion having a reduced inner diameter for clamping a portion of the core in the insertion hole.

11. A method for polishing an end face of an optical fiber, comprising the steps of:

inserting an optical fiber into an optical fiber retaining jig of a polishing machine so that a free end of the optical fiber extends beyond a contact surface of the retaining jig, the contact surface having a desired shape;

urging the contact surface of the retaining jig against a polishing member and causing relative movement between the polishing member and the contact surface to polish the free end of the optical fiber into the desired shape; and acquiring an image of the free end of the optical fiber using an inspection unit while light is being passed through the optical fiber without removing the optical fiber from the retaining jig to enable inspection of the polishing progress of the free end portion of the optical fiber and determination of a position of a core on the end face of the optical fiber.

12. A method for polishing an end face of an optical fiber according to claim 11; wherein the step of acquiring an image of the free end of the optical fiber comprises the step moving the retaining jig from a first position at which the end face is urged against the polishing member to a second position at which the end face is disposed proximate an image sensor of the inspection unit while the optical fiber is retained by the retaining jig.

13. A method for polishing an end face according to claim 12; wherein the step of determining a position of the optical fiber core is performed based on a symmetric property revealed by the image.

14. A method for polishing an end face according to claim 12; wherein the step of passing light through the optical fiber comprises passing laser beam light through the optical fiber.

* * * * *